US005845348A

United States Patent [19]

Dunn et al.

[11] Patent Number: 5,845,348

[45] Date of Patent: Dec. 8, 1998

[54] INVALID HOIST

[75] Inventors: Robert Dunn, Cheltenham; Bruce Edward Somerton, Norton, both of England

[73] Assignee: Arjo Limited, Gloucester, England

[21] Appl. No.: 809,634

[22] PCT Filed: Sep. 5, 1995

[86] PCT No.: PCT/GB95/02090

§ 371 Date: Mar. 18, 1997

§ 102(e) Date: Mar. 18, 1997

[87] PCT Pub. No.: WO96/22757

PCT Pub. Date: Aug. 1, 1996

[30] Foreign Application Priority Data

Jan. 27, 1995 [GB] United Kingdom ..... 9501629
Mar. 6, 1995 [GB] United Kingdom ..... 9504426

[51] Int. Cl.[6] ..... A61G 7/10

[52] U.S. Cl. ..... 5/83.1; 5/86.1

[58] Field of Search ..... 5/86.1, 83.1, 85.1, 5/87.1, 81.1 R

[56] References Cited

U.S. PATENT DOCUMENTS 5,185,895 2/1993 Gagne et al. ..... 5/86.1
5,365,621 11/1994 Blain ..... 5/86.1

FOREIGN PATENT DOCUMENTS 2 678 165 12/1992 France .
713244 8/1954 United Kingdom .
2 105 677 3/1983 United Kingdom .
2 222 814 3/1990 United Kingdom .

*Primary Examiner*—Alexander Grosz
*Attorney, Agent, or Firm*—Young & Thompson

[57] ABSTRACT

An invalid hoist comprises a telescopic mast (11) having a lower part (18) and an upper part (19), power operated device for raising and lowering the upper part relative to the lower part, a lifting arm (12) pivotably connected to the upper part of the mast, the lifting arm having a sling hanger (23) or at least one sling attachment point at or adjacent to one end thereof, and a manually extendable/retractable stay (30) between the lifting arm and the lower mast part. The lifting arm is pivotally connected to the upper part of the mast at a position intermediate its ends and the extendable/retractable stay is connected to the lifting arm on the side of the pivotable connection between the lifting arm and the upper apart of the mast remote from the one end of the lifting arm. The stay can be extended, if the power operated device fails with the upper part of the mast in a raised position, to lower a user to a position in which he/she can be released from a sling supported by the lifting arm. It can also be extended, when the upper mast part is in its lowermost position, to move the lifting arm to a storage position alongside the telescopic mast.

16 Claims, 5 Drawing Sheets

INVALID HOIST

FIELD OF THE INVENTION

This invention relates to an invalid hoist.

SUMMARY OF THE INVENTION

According to the invention there is provided an invalid hoist comprising a telescopic mast having a lower part and an upper part, power operated means for raising and lowering the upper part relative to the lower part, a lifting arm pivotably connected to the upper part of the mast, the lifting arm having a sling hanger or at least one sling attachment point at or adjacent to one end thereof, and a manually extendable/retractable stay between the lifting arm and the lower part of the mast, the lifting arm being pivotably connected to the upper part of the mast at a position intermediate its ends and the extendable/retractable stay being connected to the lifting arm on the side of the pivotable connection between the lifting arm and the upper part of the mast remote from said one end of the lifting arm.

Preferably, the mast is mounted on a mobile chassis.

The stay can be extended, if the power operated means fails with the upper part of the mast in a raised position, to lower a user to a position in which he/she can be released from a sling supported by the lifting arm. This is a very useful safety feature not hitherto incorporated in a power operated invalid hoist.

The stay can also be extended, when the upper mast part is in its lowermost position, to move the lifting arm to a storage position alongside the telescopic mast.

Preferably the stay includes two threaded members which are rotatable relative to one another to extend and retract the stay.

Where a sling hanger is supported by the free end of the lifting arm, the sling hanger may be pivotable about a horizontal axis and may have two spaced sling attachment points on one side of the axis and at least one sling attachment point on the other side of the axis to support a body support sling.

Preferably, a handle is provided on the lifting arm for allowing an operator to move the hoist along a floor. In this case, the handle may extend at least part way along each of two opposite side of the lifting arm and may have a transverse portion adjacent to the rear end of the lifting arm.

BRIEF DESCRIPTION OF THE DRAWINGS

The invention will now be more particularly described, by way of example, with reference to the accompanying drawings in which.

DETAILED DESCRIPTION OF THE INVENTION

Referring firstly to FIGS. 1 to 4 of the drawings, the invalid hoist shown therein comprises a mobile chassis 10, a lifting column 11 upstanding from the chassis 10 and a lifting arm 12 supported by the lifting column 11.

Figure 1:
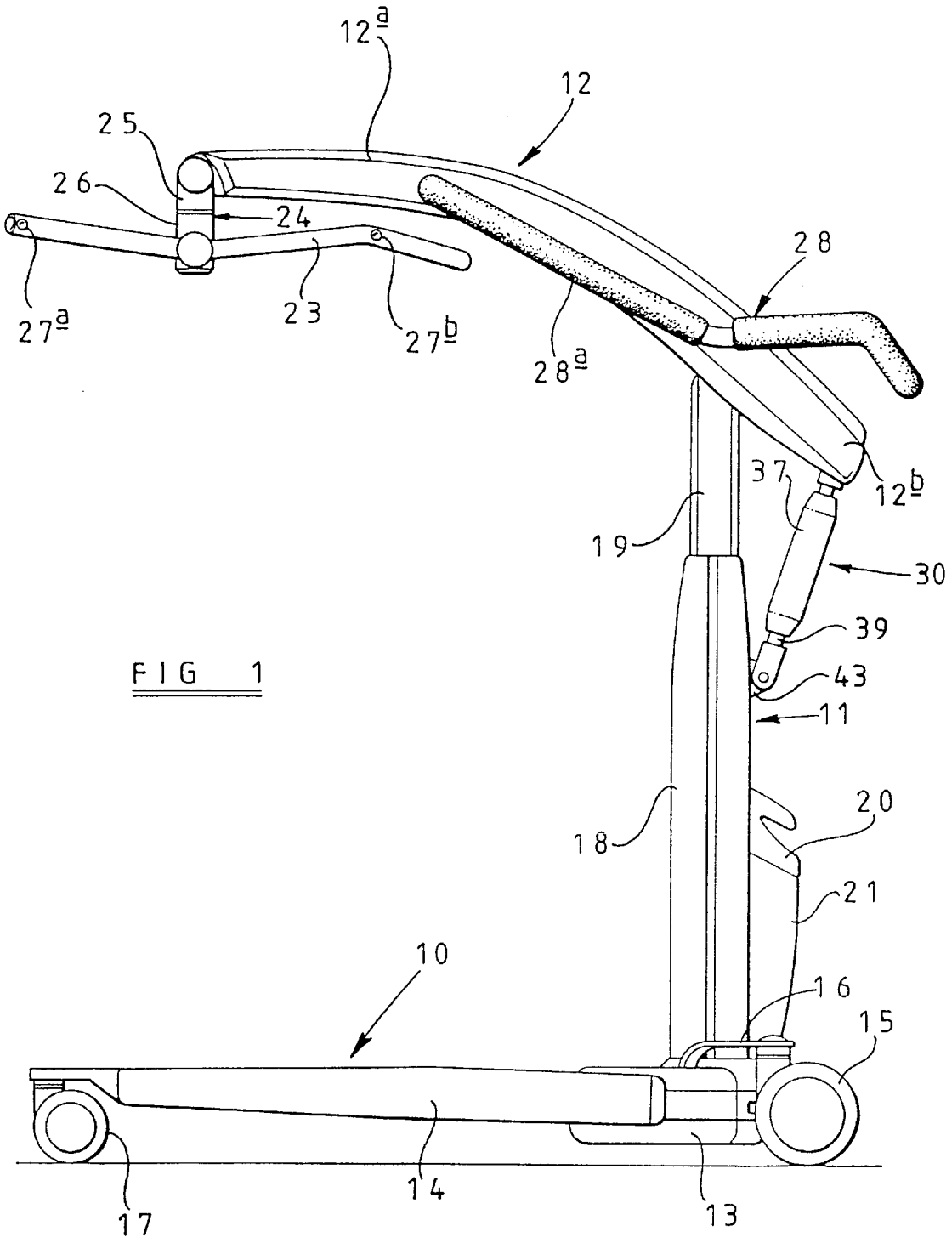
FIG. 1 is a side view of one embodiment of an invalid hoist according to the invention, the hoist being shown in an in use condition.
Figure 2:
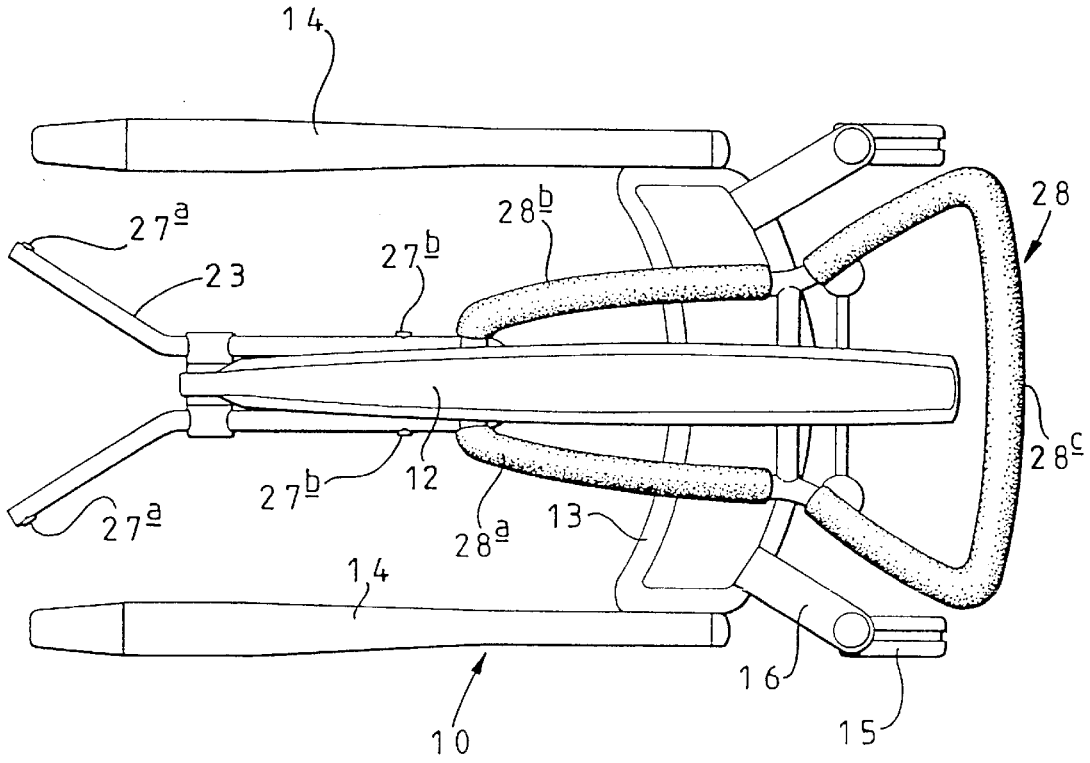
FIG. 2 is a plan view of the hoist shown in FIG. 1.
Figure 3:
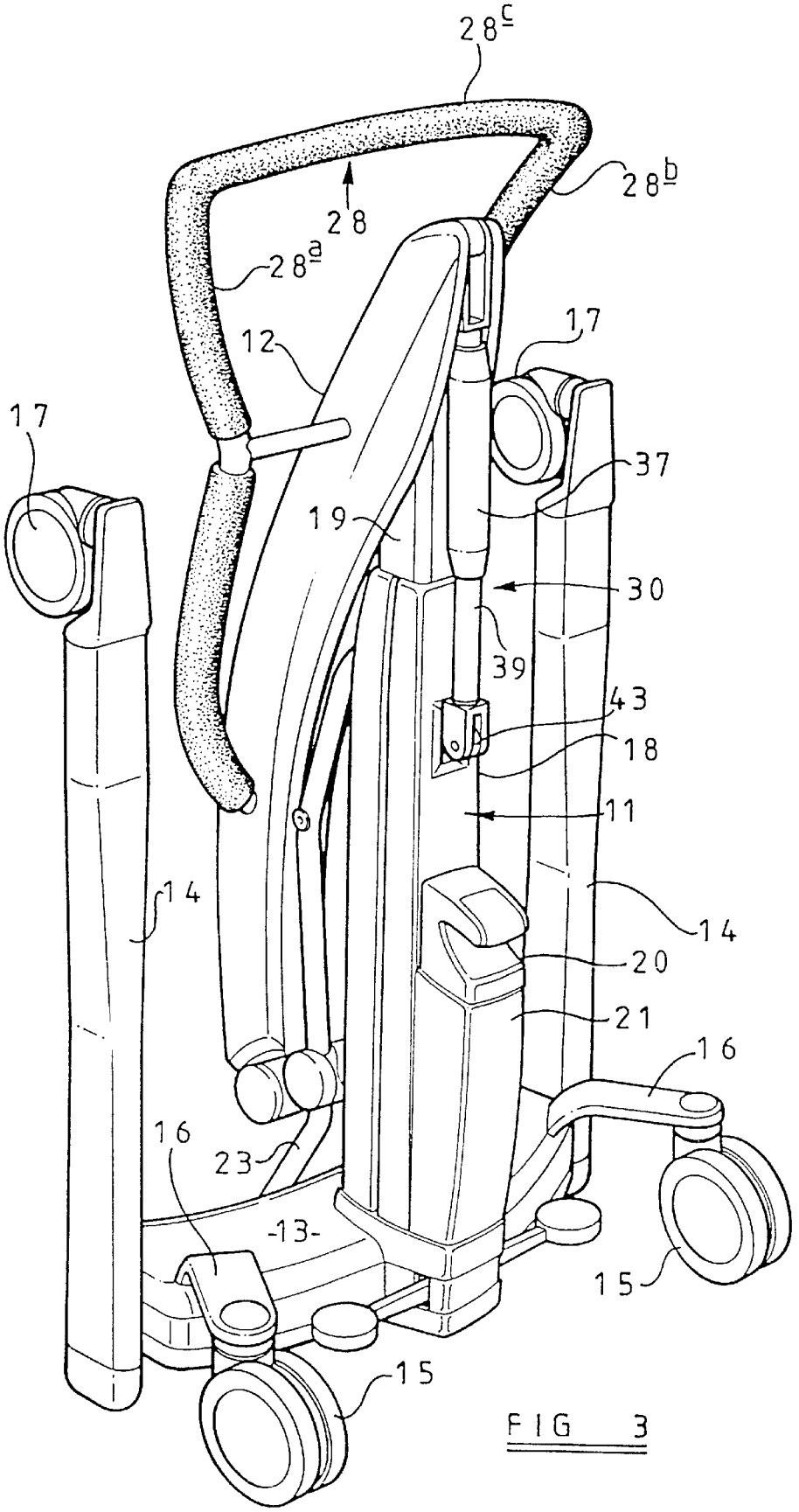
FIG. 3 is a perspective view of the hoist shown in FIGS. 1 and 2 but shown in a collapsed storage condition.
Figure 4:
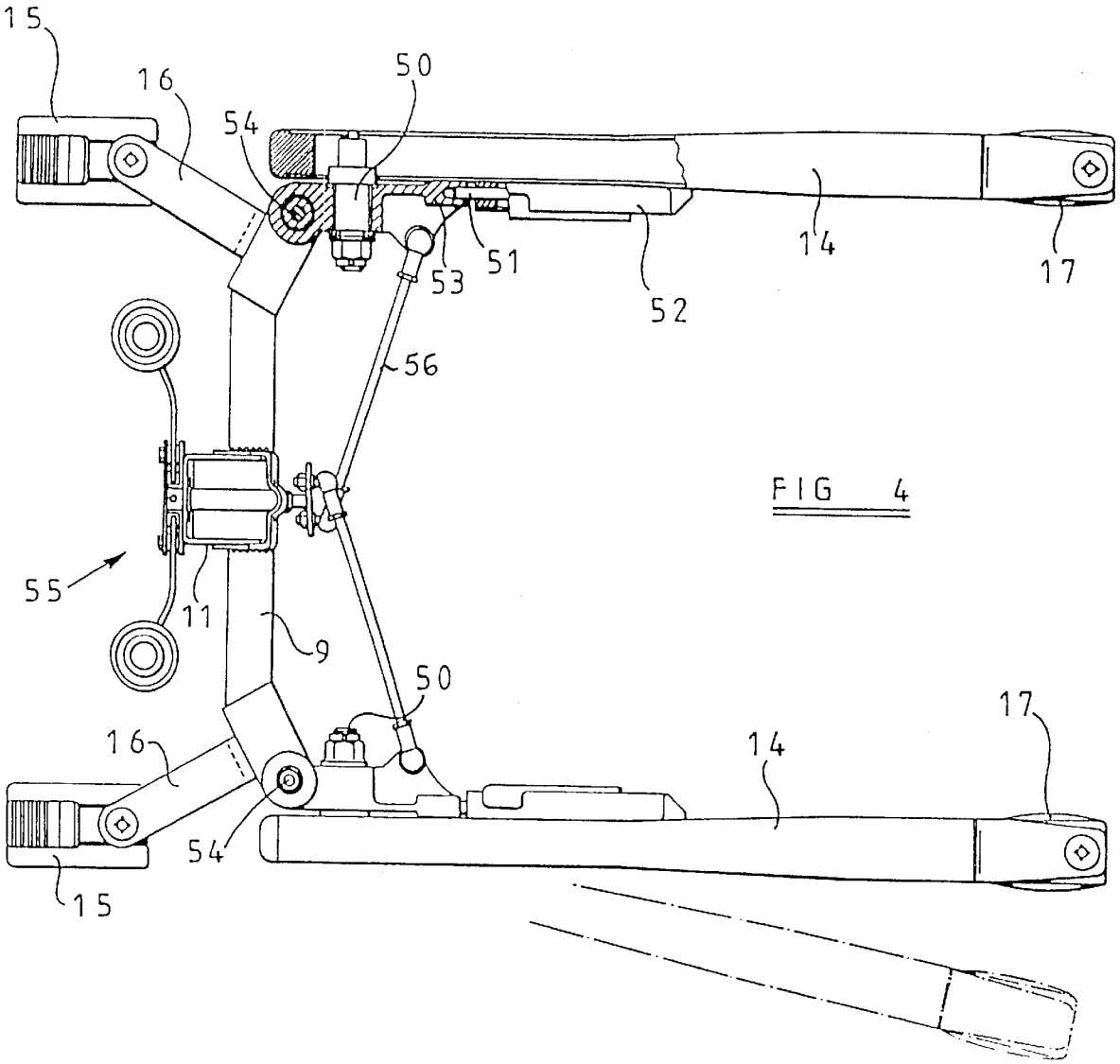
FIG. 4 is a sectional view through the mast and showing the chassis of the hoist with the cover removed.

As shown in FIG. 4, the chassis 10 comprises a main chassis portion 9 extending transversely of the hoist and two side members 14. The side members 14 are pivotable relative to the main chassis portion 9 in respective vertical planes between a first in use position (as shown in FIGS. 1,2 and 4) in which they project forwardly from the main portion 9 and a second storage position (as shown in FIG. 3) in which they extend parallel or substantially parallel to the lifting column 11 and in which they lie in a common vertical plane offset slightly from the lifting column 11. The side members 14 are also pivotable relative to the main chassis portion 9 (when in an in use position) in a common horizontal plane to increase the width of the front opening of the chassis to fit around, for example, a wheelchair. To achieve this, connecting arms 56 are provided between the main chassis portion 9 and the side members 14. The connecting arms 56 are pivotably connected to opposite ends of the main chassis portion 9 for pivotable movement about respective vertical axes 54 and the side members 14 are pivotably connected to respective connecting arms 56 for pivotable movement relative thereto about respective horizontal axes 50. A mechanism 55 is provided for pivoting the connecting arms 56 relative to the main chassis portion 9 so as to open and close the side members 14 and releasable fastening means are provided between the side members 14 and respective connecting arms 56 to retain the side members in an in use position. The releasable fastening means may take the form of bolts 51 slidably mounted in holders 52 mounted on the side members 14 and sockets 53 supported by the connecting arms 56.

The main chassis portion 9 and the connecting arms 56 are enclosed in a cover 13 to improve the aesthetic appearance of the hoist.

The main chassis portion 9 is provided with two wheels or castors 15 supported by brackets 16 and each side member 14 is provided with a single wheel or castor 17 provided at or adjacent to its front end.

The side members 14 each project rearwardly of the axis 50 about which they are pivotably connected to the connecting arms 56 (as considered in an in use position) to such an extent that when they are in the second storage position the rear ends of the side members 14 and the two wheels or castors 15 provided on the main chassis portion 13 together support the hoist in a stable upright position (as shown in FIG. 3).

The lifting column 11 is in the form of a telescopic actuator which itself forms a mast having a lower part 18 which is secured to the main chassis portion 9 and an upper part 19. The telescopic actuator 11 is powered by a rechargeable battery 20 mounted in a compartment 21 at the rear of the actuator.

The lifting arm 12 is pivotably connected to the upper end of the upper mast part 19 and has a first limb 12*a* extending forwardly of the actuator and a second relatively shorter limb 12*b* extending rearwardly of the mast. The rear end of the limb 12*b* is connected by a stay 30 to the lower mast part 18 so that when the mast 11 is extended, the lifting arm 12 will pivot upwards and, when the mast 11 is retracted, the lifting arm 12 will pivot downwards.

Figure 5:
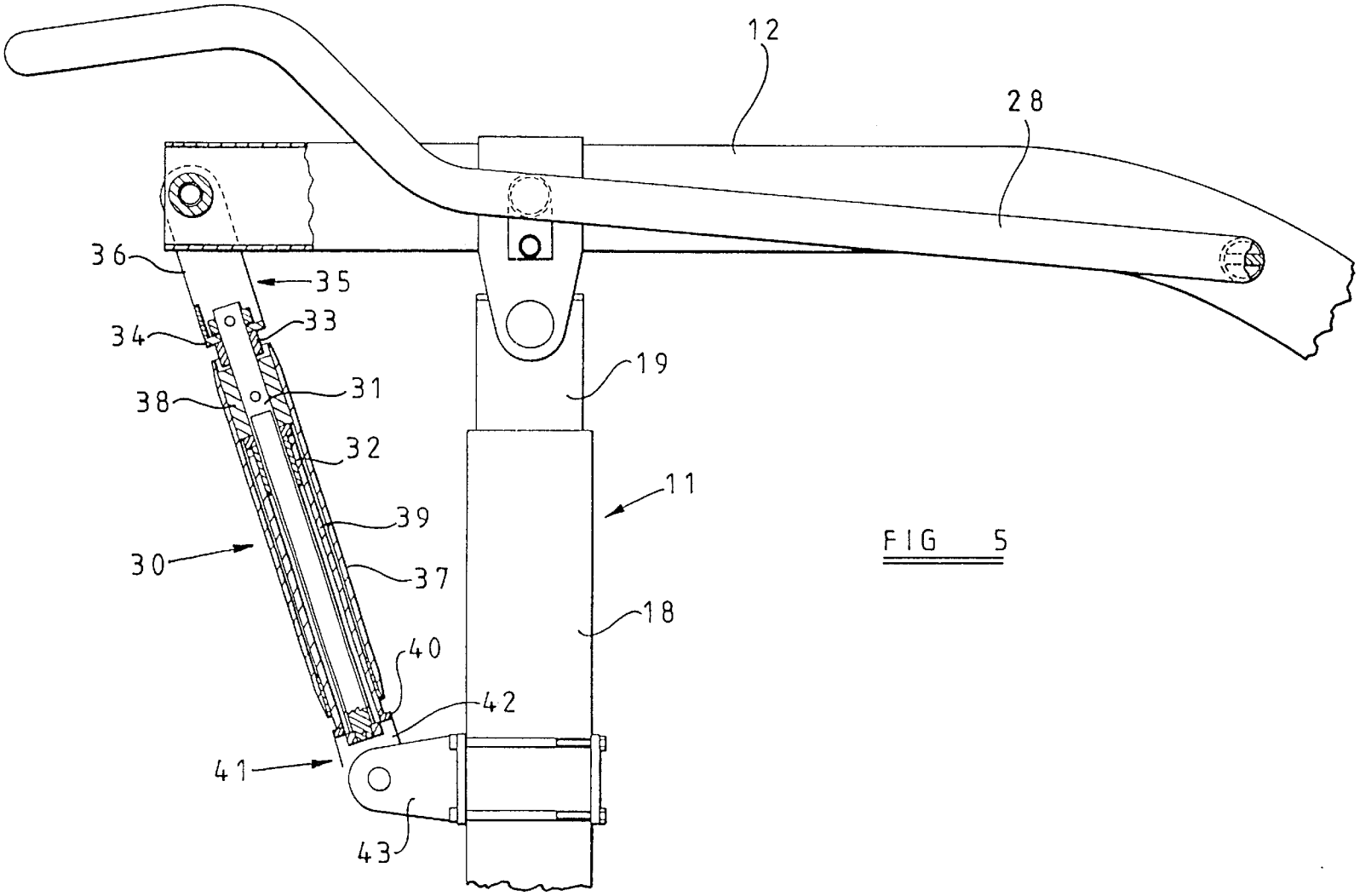
FIG. 5 is a fragmentary side view, partly in section, showing a part of the hoist shown in FIG. 1, with the covers which give the lifting arm and lower mast part a better aesthetic appearance removed.

As shown in FIG. 5, the stay 30 is extendible and retractable and comprises an externally threaded spindle 31 and an internally threaded nut 32. The spindle 31 is mounted for rotation in a bush 33 welded to the web 34 of a U-shaped bracket 35 which is pivotably connected adjacent to the free ends of its two arms 36 to the rear end of the lifting arm 12. A sleeve 37 is connected to the spindle 31 by a collar 38 so that the sleeve 37 surrounds the spindle 31 and an annular space is provided between the spindle 31 and the sleeve 37.

The extendable and retractable stay 30 is incrementally adjustable in length between two extreme limit positions.

The nut 32 is secured to a further sleeve 39 which is secured to the web 40 of a further U-shaped bracket 41 pivotably connected adjacent to the free ends of its two arms 42 to a lug 43 clamped to the lower mast part 18. The nut 32 and further sleeve 39 are located in the annular space between the spindle 31 and the sleeve 37 and the nut 32 co-operates with the spindle 31.

The spindle 31 can be rotated relative to the nut 32 to extend or retract the stay 30 by rotating the sleeve 38. This will allow the lifting arm 12 to be lowered, if the actuator 11 fails with the upper mast part 19 in a raised position, to lower a user to a position in which he/she can be released from a sling supported by the lifting arm 12. It will also allow the lifting arm 12 to be moved between its operative position (shown in FIGS. 1 and 2) and its storage position (shown in FIG. 3) alongside the mast.

A sling hanger 23 is connected to the front end of the lifting arm 12 by a sling hanger support 24. The support 24 comprises two parts 25 and 26 rotatable relative to one another about a vertical or substantially vertical axis. The part 25 is pivotably connected to the lifting arm about a first horizontal axis and the sling hanger 23 is pivotably connected to the second part 26 about a second horizontal axis.

The sling hanger 23 has two widely spaced sling attachment points 27*a* on one side of the second horizontal axis and two more closely spaced sling attachment points 27*b* on the other side of the second horizontal axis. A single body support sling can then be attached to the sling attachment points 27*a*, 27*b* to support a patient. The two sling attachment points 27*b* could be replaced by a single attachment point.

A handle 28 is provided on the lifting arm to allow an operator to move the hoist along a floor surface. The handle 28 has two side limbs 28*a* and 28*b* which extend along each of two opposite sides of the lifting arm 12 and a transverse portion 28*c* adjacent to the rear end of the lifting arm 12. This allows the operator to manoeuvre the hoist from either side or from the rear of the hoist.

The above embodiments are given by way of example only and various modifications will be apparent to persons skilled in the art without departing from the scope of the invention. For example, the actuator could be provided within an outer telescopic housing instead of defining the mast by itself.

We claim:

1. An invalid hoist comprising a telescopic mast having a lower part and an upper part, power operated means for raising and lowering the upper part relative to the lower part, a lifting arm pivotably connected to the upper part of the mast, the lifting arm having one of a sling hanger and at least one sling attachment point adjacent to one end of said lifting arm, and a manually extendable/retractable stay between the lifting arm and the lower part of the mast, the stay including two threaded members which are rotatable relative to one another to extend and retract the stay, the lifting arm being pivotably connected to the upper part of the mast at a position intermediate its ends and the extendable/retractable stay being connected to the lifting arm on the side of the pivotable connection between the lifting arm and the upper part of the mast remote from said one end of the lifting arm.

2. An invalid hoist as claimed in claim 1, wherein the mast is mounted on a mobile chassis.

3. An invalid hoist as claimed in claim 1, wherein the stay can be extended, if the power operated means fails with the upper part of the mast in a raised position, to lower a user to a position in which the user can be released from a sling supported by the lifting arm.

4. An invalid hoist as claimed in claim 1, wherein the stay can be extended, when the upper mast part is in its lowermost position, to move the lifting arm to a storage position alongside the telescopic mast.

5. An invalid hoist as claimed in claim 1, wherein a sling hanger is supported by the free end of the lifting arm.

6. An invalid hoist as claimed in claim 5, wherein the sling hanger is pivotable about a horizontal axis and has two spaced sling attachment points on one side of the axis and at least one sling attachment point on the other side of the axis.

7. An invalid hoist as claimed in claim 1, wherein a handle is provided on the lifting arm for allowing an operator to move the hoist along a floor.

8. An invalid hoist as claimed in claim 7, wherein the handle extends at least part way along each of two opposite sides of the lifting arm and has a transverse portion adjacent to the rear end of the lifting arm.

9. An invalid hoist comprising a telescopic mast having a lower part and an upper part, power operated means for raising and lowering the upper part relative to the lower part, a lifting arm pivotably connected to the upper part of the mast, the lifting arm having one of a sling hanger and at least one sling attachment point adjacent to one end of said lifting arm, and a manually extendable/retractable stay between the lifting arm and the lower part of the mast, the lifting arm being pivotably connected to the upper part of the mast at a position intermediate its ends, the extendable/retractable stay being incrementally adjustable in length between two extreme limit positions, and being connected to the lifting arm on the side of the pivotable connection between the lifting arm and the upper part of the mast remote from said one end of the lifting arm, whereby the stay can be extended, when the upper part is in its lowermost position, to move the lifting arm to a storage position alongside the telescopic mast.

10. An invalid hoist as claimed in claim 9, wherein the mast is mounted on a mobile chassis.

11. An invalid hoist as claimed in claim 9, wherein the stay can be extended, if the power operated means fails with the upper part of the mast in a raised position, to lower a user to a position in which the user can be released from a sling supported by the lifting arm.

12. An invalid hoist as claimed in claim 9, wherein the stay includes two threaded members which are rotatable relative to one another to extend and retract the stay.

13. An invalid hoist as claimed in claim 9, wherein a sling hanger is supported by the free end of the lifting arm.

14. An invalid hoist as claimed in claim 13, wherein the sling hanger is pivotable about a horizontal axis and has two spaced sling attachment points on one side of the axis and at least one sling attachment point on the other side of the axis.

15. An invalid hoist as claimed in claim 9, wherein a handle is provided on the lifting arm for allowing an operator to move the hoist along a floor.

16. An invalid hoist as claimed in claim 15, wherein the handle extends at least part way along each of two opposite sides of the lifting arm and has a transverse portion adjacent to the rear end of the lifting arm.

* * * * *